United States Patent [19]

Teshirogi

[11] Patent Number: 4,584,581

[45] Date of Patent: Apr. 22, 1986

[54] BEAM FORMING NETWORK FOR MULTIBEAM ARRAY ANTENNA

[75] Inventor: Tasuku Teshirogi, Koganei, Japan

[73] Assignee: Radio Research Laboratories, Ministry of Posts and Telecommunications, Koganei, Japan

[21] Appl. No.: 365,265

[22] Filed: Apr. 5, 1982

[30] Foreign Application Priority Data

Oct. 27, 1981 [JP] Japan ..... 56-170673

[51] Int. Cl.[4] ..... H01Q 3/40

[52] U.S. Cl. ..... 343/373; 307/513

[58] Field of Search ..... 343/350, 354, 368–373, 343/754, 757, 853, 700 MS, DIG. 2; 333/109; 328/24, 155; 307/262, 512, 513

[56] References Cited

U.S. PATENT DOCUMENTS

| | | | |
|---|---|---|---|
| 3,176,297 | 3/1965 | Forsberg | 343/371 |
| 3,255,450 | 6/1966 | Butler | 343/373 |
| 3,345,585 | 10/1967 | Hildebrand | 343/373 |
| 3,422,438 | 1/1969 | Marston | 343/368 |
| 3,621,406 | 11/1971 | Johns | 307/262 X |
| 4,041,501 | 8/1977 | Frazita et al. | 343/373 |
| 4,223,283 | 10/1980 | Chan | 333/109 |
| 4,231,040 | 10/1980 | Walker | 343/373 |

FOREIGN PATENT DOCUMENTS

| | | | |
|---|---|---|---|
| 979971 | 1/1965 | United Kingdom | 343/373 |

*Primary Examiner*—Theodore M. Blum
*Assistant Examiner*—Gilberto Barrón, Jr.
*Attorney, Agent, or Firm*—Schwartz & Weinrieb

[57] ABSTRACT

A resistive-coupling type beam forming network for a multibeam array antenna involving symmetry in the arrangement of antenna elements and/or the arrangement of beams. In the network, a matrix is formed of distribution lines from four-phase splitters each receiving two input signals in the relationship of mutual complex conjugates and outputting four-phase signals, output summing lines and coupling resistors for coupling specific distribution lines with output summing lines. Owing to the fact that each four-phase splitter and each set of four distribution lines per splitter can be shared for two input signals of complex conjugates, and where the arrangement of beams or antenna elements on the output side has symmetry, each coupling resistor can be shared for two output signals of complex conjugates, the number of coupling points of the matrix is notably decreased, beam forming characteristics are improved and the size and weight of the whole network are reduced accordingly.

18 Claims, 8 Drawing Figures

BEAM FORMING NETWORK FOR MULTIBEAM ARRAY ANTENNA

FIELD OF THE INVENTION

This invention relates to a multibeam forming network for a multibeam array antenna, and more particularly to a multibeam forming network which permits the network configuration to be notably reduced in both weight and size by reducing the number of coupling resistors which make up a matrix.

BACKGROUND OF THE INVENTION

In satellite communication systems which provide telecommunication links of high quality for fixed radio communications and for mobile radio communications utilized in ships and aircrafts, since the satellite-borne power sources have their own limits, there usually is adopted a device for heightening antenna gains rather than increasing transmitter outputs. The high-gain antennas utilizing spot beams, however, have sharp directivity and consequently are restricted to narrow service areas. Thus, multibeam antennas offering wider service areas by use of multiple spot beams have come to be adopted.

The multibeam antennas come in various types. For use in mobile-satellite communications, multibeam array antennas which can have their cross-over levels heightened by narrowing the spaces separating the adjacent beams are suitable. For the multibeam array antenna, the beam forming network which serves to distribute signals from the individual antenna elements, provide proper phase shift, and synthesize a multibeam constitutes itself an important device.

Butler matrix, Blass feed, and resistive matrix are examples of heretofore well-known beam forming networks available for the multibeam array antenna. The Butler matrix offers the merit that it can be composed of lossless circuits. It nevertheless has a disadvantage in that it permits no free beam formation because it entails a definite relation between the beam width and the spaces separating the adjacent beams. When the Butler matrix is applied for the planar array antenna, it becomes complicated and massive, and, therefore, is not suitable for installation on a satellite. In contrast, the resistive matrix can be constructed rather compactly with microstrip circuits and, therefore, proves particularly convenient for installation on a satellite.

The resistive coupling matrix is composed of a quadrature phase splitter serving to divide input signals into signals of four phases each of 90° and a group of coupling resistors serving to connect the lines from the phase splitter from which signals involving a phase difference of 90° are outputted with corresponding output summing lines. By suitably selecting signals involving a phase difference of 90° and resistance values of coupling resistors, this network enables signals of desired phases to be selectively fed into the output summing lines. This beam forming network can be applied to array antennas having antenna elements in arbitrary arrangements and has the outstanding advantage that multiple beams can be formed in desired directions. Moreover, it can be constructed rather simply such as with microstrip lines, for example. This resistive coupling matrix, therefore, serves particularly advantageously as a beam forming network for the multibeam antenna to be borne on a satellite. It is, however, generally used in the intermediate frequency band because the network is susceptible to loss. Examples of the beam forming network using a quadrature phase splitter and coupling resistors are found in the dissertation titled "Fixed beam forming, in 'Phased Array Radar Studies, 1 July 1959 to 1 July 1960'" written by S. Spoerri and published in Part 2, Chapter 4, Technical Report No. 228 (1960), MIT Lincoln Laboratory and in the dissertation titled "Multibeam Generation at L-Band: A Phased-Array Approach," written by R. Coirault and W. Kriedte and published in European Space Agency Journal, 1980, Vol. 4, pp 319–336.

When symmetry exists in the arrangement of elements and/or the arrangement of beams, the input signals and/or output signals of symmetrically arranged elements and/or beams are disposed mutually complex conjugates. This fact evinces the requirement that the phase shifts which the beam forming network ought to give should also have the relationship of mutually complex conjugates respective to symmetrical arrangements of elements and/or beams.

Moreover, it should be noted that the number of coupling points involved in this matrix is $2\times M\times N$ on the maximum, wherein N stands for the number of antenna elements and M the number of beams. Further, the number of antenna elements generally increases proportionally with the increasing number of beams. In the multibeam antenna which has a large number of beams, therefore, the matrix becomes notably bulky and consequently entails various difficulties structurally and also from the standpoint of electrical properties. This beam forming network is inherently intended for application to multibeam antennas involving arbitrary arrangements of antenna elements and beams. It has been heretofore applied in its unaltered form to multibeam antennas wherein practically important arrangements of antenna elements and beams involve symmetry. Owing to the problems issuing from the bulky structure of the matrix mentioned above, it has found utility in a limited range of applications.

OBJECTS OF THE INVENTION

An object of this invention is to provide a multibeam forming network for a multibeam array antenna involving symmetry in the arrangement of antenna elements and/or the arrangement of beams, which network permits reduction in the number of coupling resistors making up the resistive matrix by making use of this symmetry and consequently in the size and weight of the network itself and enjoys excellent beam forming characteristics.

SUMMARY OF THE INVENTION

To accomplish the object described above according to this invention, there is provided a multibeam forming network for the multibeam array antenna, which network comprises quadrature phase splitters for receiving two input signals per phase splitter and outputting four-phase signals of different phases, and a matrix formed of distribution lines adapted to deliver the four-phase signals outputted from each of the phase splitters, output summing lines and coupling resistors for coupling specific distribution lines with pertinent output summing lines.

The quadrature phase splitters are respectively formed by combining $\pi$-hybrids, or adding $\pi/2$ fixed phase shifters or $\pi/2$-hybrids and are adapted to cause phase shift in the two input signals obtained from symmetrically arranged antenna elements or symmetric beams on the input side and give rise to four-phase signals mutually shifted by a $\pi/2$ phase. Where the arrangement of the beams or the antenna elements on the output side lacks symmetry, one of the phase signals outputted from the phase splitters, which represent the real part and one of the phase signals which represent the imaginary part are coupled with each output summing line through the medium of coupling resistors. Where the arrangement of the beams or the antenna elements on the output side involves symmetry, one of the phase signals representing the real part and one of the phase signals representing the imaginary part are coupled with the respective output summing lines through the medium of coupling resistors and two signals delivered on the summing lines are synthesized by means of the $\pi$-hybrid to discharge output signals in relation to the symmetrical arrangement of the beams or the antenna elements. Where the arrangement of the antenna elements or the beams on the output side involves symmetry, the number of coupling resistors is further halved. As a result, according to these beam forming networks, beam forming characteristics can be improved, the network construction can be reduced in size and weight and the networks can be easily manufactured. Thus, the four-phase splitter and the distribution lines can be shared for the symmetrically arranged antenna elements or the symmetrically arranged beams on the input side with the result that the number of coupling points in the matrix is halved compared with that of a conventional resistive matrix.

BRIEF DESCRIPTION OF THE DRAWINGS

The other objects and characteristics of the present invention will become apparent from the further disclosure of the invention to be made hereinbelow with reference to the accompanying drawings, wherein.

DESCRIPTION OF THE PREFERRED EMBODIMENTS

This invention relates to a beam forming network for a multibeam array antenna, which makes use of a resistive matrix of simple construction.

Figure 1:
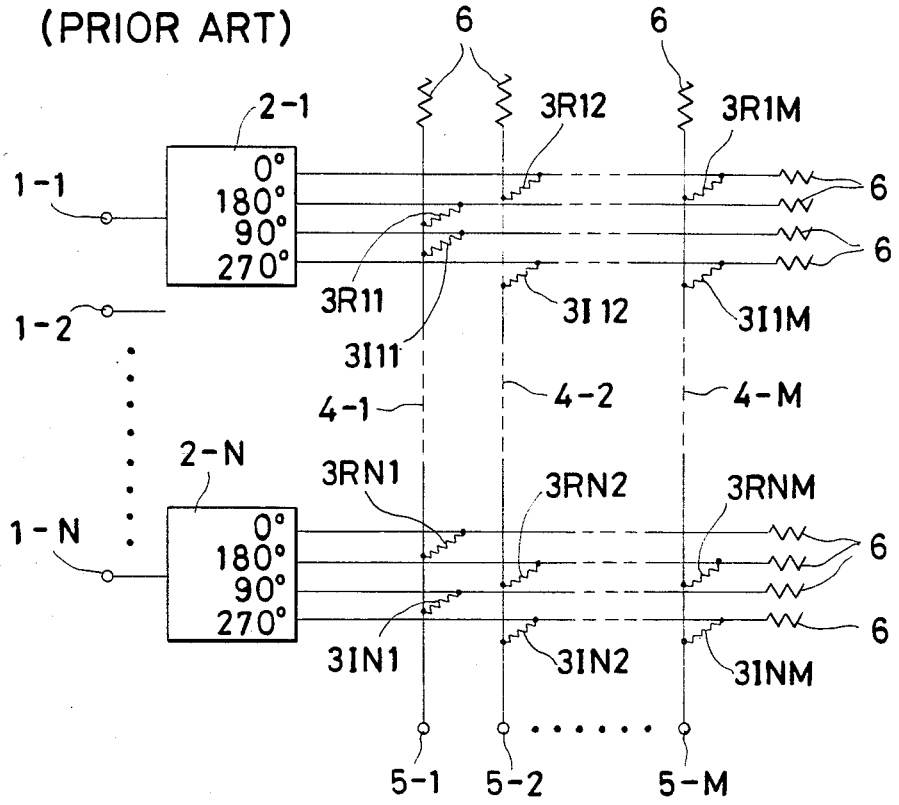
Fig 1 (PRIOR ART)
FIG. 1 is a block diagram of a known resistive matrix.

FIG. 1 represents a typical construction of the resistive matrix in a known beam forming network. To describe this construction with reference to a receiving antenna, 1-1, 1-2, . . . 1-N found in the diagram denote input terminals. There are a total of N input terminals so as to correspond to the number of antenna elements involved. Similarly 2-1, . . . , 2-N denote quadrature phase splitters. Separately, 3R11, 3R12, . . . , 3RNM denote resistors connected with the distribution lines of the phase 0° or phase 180° from the aforementioned phase splitters, 3I11, 3I12, . . . , 3INM denote resistors connected with the distribution lines of the phase 90° or phase 270° similarly from the phase splitters, 4-1, 4-2, . . . , 4-M denote output summing lines, and 5-1, 5-2, . . . , 5-M denote output terminals. These components are in the total of M to equal the number of beams involved in the multibeam array antenna. Here, the letters R and I are meant as symbols denoting the real part and the imaginary part of the signals, respectively. Denoted by 6 is a terminal resistor for precluding reflection. When this matrix is used as a transmitting antenna, the basic operation remains unchanged except that the input terminals 1-1, 1-2, . . . , 1-N are used for receiving the signals for the individual beams and the output terminals 5-1, 5-2, . . . , 5-M are connected to the relevant antenna elements. The matrix, therefore, will be described below with reference to the receiving antenna. In FIGS. 1 through 7, like symbols denote like components.

The signals received by antenna elements are frequency-converted to intermediate frequencies while retaining their coherency intact and are inputted into the beam forming network of FIG. 1 through the input terminals 1-1, 1-2, . . . , 1-N. Here, the circuits from the antennas via highfrequency amplifiers to frequency converters are not shown. The input signals are split by the quadrature phase splitters 2-1, . . . , 2-N into signals of equal amplitude shifted by a phase of 90°. Generally, of these signals, two suitable signals involving a phase difference of 90° are coupled with the output summing lines 4-1, 4-2, . . . , 4-M via the coupling resistors 3R11, 3R12, . . . , 3RNM and 3I11, 3I12, . . . , 3INM each having a resistance value determined by the phase shift to be given to the input signal to form a desired beam. Specifically, when the phase shift to be given to the input signal is of 0°, 90°, 180° or 270°, the relevant distribution line may be coupled with the pertinent output summing line through the medium of one coupling resistor. When the signals from the antenna elements are given necessary phase shifts and the resultant outputs are combined, the resultant output corresponding to the radiation beam in a specific direction can be derived through one output terminal. By configuring a matrix as illustrated in FIG. 1 by using a plurality of output summing lines and suitably selecting the resistance values for the coupling resistors, therefore, a beam forming network can be formed for the multibeam array antenna.

Compared with the Butler matrix and other conventional networks, this beam forming network has a simple, compact hardware structure. As the number of beams is increased, however, this network is inevitably increased in size, weight, and mechanical resonance so much as to induce a structural problem concerning its suitability for installation on a satellite. There is also entailed a problem from the standpoint of electrical properties. In this network, the couplings by means of resistance ought to be sufficiently small in order to avoid affecting the impedance of the input and output lines. Moreover, the individual couplings are required to decrease in proportion as the number of coupling points is increased. The resistance values of the coupling resistors, therefore, are required to be amply large as compared with the line impedances. Generally for intermediate frequencies of the order of some tens of MHz, coupling resistances in the range of some hundreds of Ω to several kΩ are used whereas the impedances of lines are in the range of several Ω to some tens of Ω. In such a frequency band, however, the effect of the reactance due to the stray capacity of the resistance itself is too large to neglect and causes an error in the phase shift. Since the effect of the reactance becomes conspicuous with the increasing resistance value, the beam forming network has its beam forming characteristic degraded in proportion as the number of beams is increased.

Further, the lengths of the output summing lines increase with the increasing size of the network. The difference in the lengths of such lines from the respective elements, consequently, brings about an appreciable phase change and entails a problem for the correction of such phase change.

All these problems originate in the multiplicity of coupling points in the matrix. If the number of coupling points can be decreased as by shared use of coupling resistors, for example, these problems will be substantially solved.

Many, if not all, of the multibeam array antennas which are currently in actual service have symmetry in the arrangement of elements and/or the arrangement of beams. Even for these antennas, networks of the configuration as illustrated in FIG. 1 have been adopted in their unaltered form and, hence, have suffered from the various disadvantages mentioned above.

This invention, primarily aimed at precluding such disadvantages, has materialized a multibeam forming network for a multibeam array antenna involving symmetry in the arrangement of elements and/or the arrangement of beams, which multibeam forming network, by making use of this symmetry, permits reduction in the number of coupling points and consequently in the size and weight and provides excellent beam forming characteristics. Now, one embodiment of this invention will be described in detail below with reference to the accompanying drawing.

Figure 2:
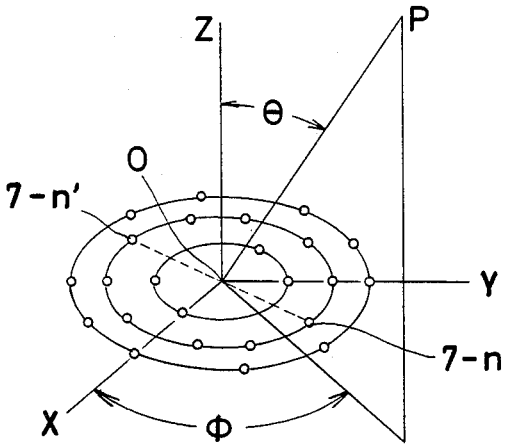
FIG. 2 is a diagram illustrating a planar array antenna formed of symmetrically arranged elements and a coordinates system.

First, the symmetry which exists in the arrangements of antenna elements and beams will be described. FIG. 2 illustrates a symmetrical ring array and a coordinate system. In this array, the common center of the rings is positioned in the X-Y plane so as to coincide with the origin O of the coordinate system. The direction of the observation point P is expressed by the polar coordinates ($\theta$, $\phi$). On the rings, all or part of the antenna elements are paired off in two members, and the paired elements are assumed to be symmetrically located with respect to the common center of the rings. In this diagram, for example, the elements 7-n and 7-n' form a symmetrical pair. The array antennas which have this type of symmetry include numerous planar array antennas such as the rectangular array antenna and triangular array antenna which are in popular use.

Now, the symmetry in the arrangement of beams will be described. Similar to the arrangement of elements, all or part of the beams are symmetrically paired. With reference to FIG. 2, if one beam runs in the direction of $\theta$, $\phi$, for example, then the opposite beam of the pair runs in the direction of $\theta$, $\phi+\pi$.

A study of the excitation phases in the multibeam array antenna which has the symmetry in the arrangements of antenna elements and beams as described above reveals that they involve the following relations.

(1) The phases of the two antenna elements which are symmetrically arranged to form a given beam are equal in magnitude and opposite in sign. In other words, the excitation signals of the two antenna elements are in the relationship of mutual complex conjugates.

(2) When two symmetrical beams are formed, the excitation signals which a given antenna element gives to the two beams are in the relationship of mutual complex conjugates.

Figure 3:
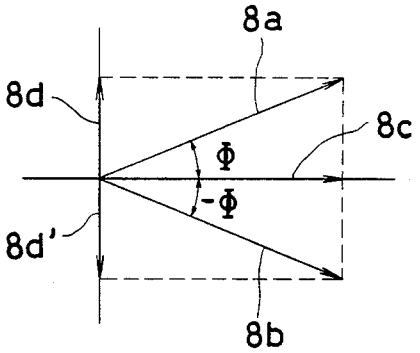
FIG. 3 is a vector diagram representing the phase relation of excitation signals in the relationship of complex conjugates.

FIG. 3 is a phase vector diagram. In this diagram, 8*a* and 8*b* illustrate the phase relation of signals which are in the relationship of mutual complex conjugates. A review of this diagram with reference to the beam forming network of FIG. 1 reveals that in the two signals which are in the relationship of mutual complex conjugates, the real parts 8*c* of the signals are equal in both magnitude and sign and the imaginary parts 8*d* and 8*d'* are equal in magnitude but opposite in sign.

When employing the foregoing characteristics, the quadrature phase splitters and the distribution lines are shared for the two input signals which are in the relationship of mutual complex conjugates. Also for two output signals which are similarly in the relationship of mutual complex conjugates, shared use of the coupling resistors can be realized.

Figure 4:
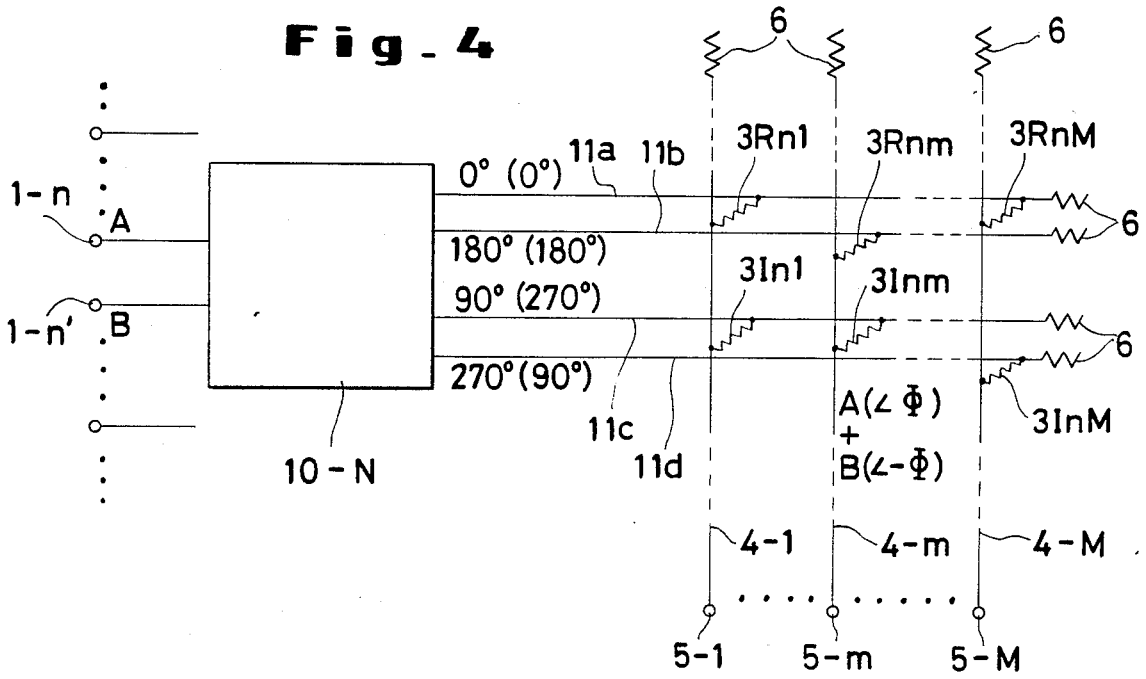
FIG. 4 is a schematic diagram illustrating the construction of one embodiment of the beam forming network according to the present invention.

FIG. 4 schematically illustrates a first embodiment of the multibeam forming network of the present invention, which is adapted for a case in which two input signals are in the relationship of mutual complex conjugates. The relationship of complex conjugates can be obtained by symmetrically arranged antenna elements in a receiving antenna or the beams in a transmitting antenna. The multibeam forming network is formed of a plurality of splitters 10 (the n'th splitter 10-N alone is shown in FIG. 4) for combining and phase shifting the input signals A, B and outputting four phase signals shifted by a phase $\pi/2$, distribution lines 11 (the line 11*a*–11*d* forming the N'th pair alone is shown) for extracting the four phase signals from the splitters 10, output adder lines 4-1, . . . 4-m, . . . 4-M, forming a matrix in conjunction with the distribution lines 11, and coupling resistors 3Rnm, 3Inm for coupling the specific distribution line 11 with the specific output summing line 4-m. As illustrated in FIG. 4, the phase signals delivered by the first and second distribution lines 11*a* and 11*b* from the phase splitter 10-N represent the real part and possess a phase relationship of 0° or 180° relative to the two input signals A and B of the aforementioned phase splitter, the phase signal delivered by the third distribution line 11*c* represents the imaginary part and possesses a phase relationship of 90° relative to one of the input signals, A, and of 270° relative to the other input signal B, and the phase signal delivered by the fourth distribution line 11*d* represents the imaginary part and possesses a phase relationship of 270° relative to the aforementioned one of the input signals, A, and of 90° relative to the aforesaid other input signal B. In the present network, of the signals of the four distribution lines 11 from the phase splitters 10, one phase signal representing the real part and one phase signal representing the imaginary part are connected to one summing line through the pertinent resistor. The pattern of this connection is similar to the conventional resistive matrix, namely, the pattern shown in FIG. 1. By thus coupling the phase signals with the output summing lines via the coupling resistors, there can be obtained a signal having a desired phase shift. Then, by combining such outputs, resultant outputs corresponding to the beams in the specific direction can be extracted from the output terminals 5-1, . . . 5-m, . . . 5-M. What should be noted is the fact that two signals which are in the relationship of mutual complex conjugates are received by one phase splitter. Because of this feature, this invention permits shared use of one phase splitter and one set of four-phase distribution lines for two signals, whereas the conventional network has necessitated use of one phase splitter and four-phase distribution lines for each input signal. In the network of the present invention, therefore, the numbers of phase splitters and distribution lines are half as many as those in the conventional network. Also in this embodiment, two pertinent signals in the relationship of $\pi/2$ phase difference are coupled with one output summing line through the medium of two coupling resistors to obtain a desired phase shift. However, when phase shifts to be given to a pair of the input signals are of 0°, 90°, 180° or 270°, the relevant distribution line may be connected with a corresponding output summing line through the medium of one coupling resistor.

Several constructions are conceivable for the phase splitters 10 in the beam forming network of the present invention. Three typical constructions available for the phase splitters 10 are shown in FIGS. 5 through 7.

Figure 5:
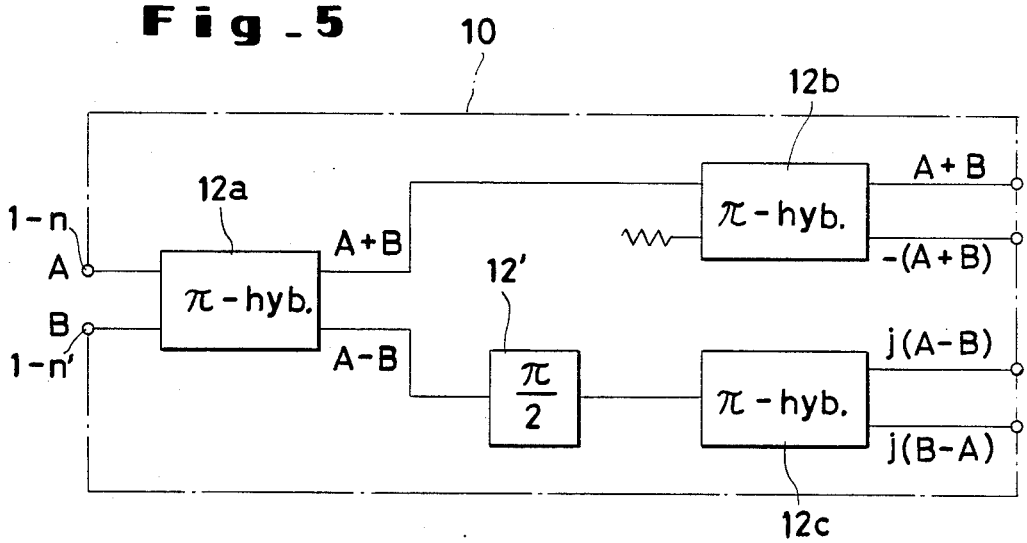
FIG. 5 through FIG. 7 are typical embodiments of the quadrature phase splitter for use in the beam forming network of this invention.

In FIG. 5, 1-n and 1-n' are input terminals from a symmetrical pair of elements such as in a receiving array antenna, for example, 12*a* to 12*c* are $\pi$-hybrids, and 12' a $\pi/2$ fixed phase shifter. Let A and B stand for the two input signals of mutual complex conjugates from the terminals 1-n and 1-n' respectively, and the two signals obtained after passage through the $\pi$-hybrid 12*a* are a sum signal (A+B) and a difference signal (A−B). The sum signal is further injected into another $\pi$-hybrid 12*b*, which discharges two signals of the phases 0° and 180° as its outputs. In the meantime, the difference signal is given a phase shift of 90° by being passed through the $\pi/2$ fixed phase shifter 12', and the resultant signal is injected into the $\pi$-hybrid 12*c*. Consequently, the phases of 90° and 270° are obtained.

Figure 6:
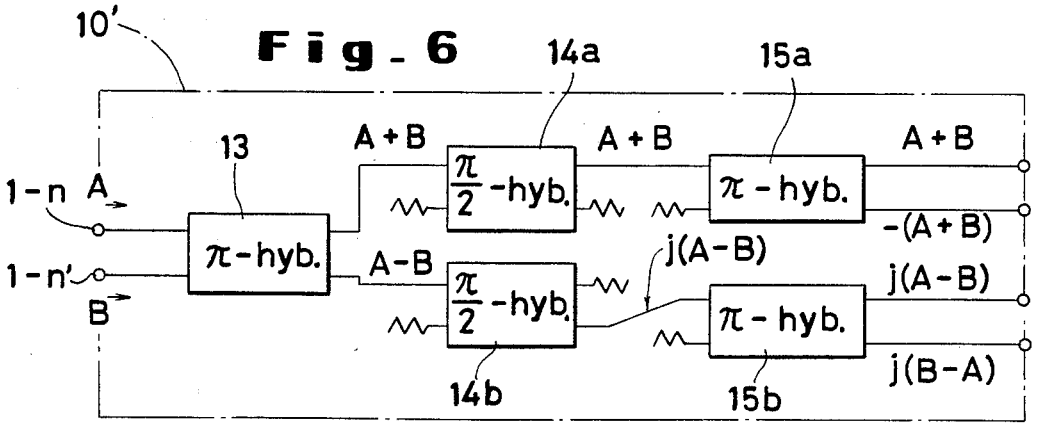

FIG. 6 represents a modification of the splitter of FIG. 5 in which the balanced configuration is adopted for real part and imaginary part systems to maintain the wide band of the frequency characteristics. The splitter 10' comprises a first $\pi$-hybrid 13 for discharging a sum signal (A+B) and a difference signal (A−B) of two input signals A and B, a first $\pi/2$-hybrid 14*a* for effecting a $\pi/2$ phase shift upon the sum signal (A+B) from the first $\pi$-hybrid 13, a second $\pi$-hybrid 15*a* for discharging two phase signals (A+B) and −(A+B) having a $\pi$ phase relation based on the output from the first $\pi/2$-hybrid 14*a*, a second $\pi/2$-hybrid 14*b* for effecting a $\pi/2$ phase shift upon the difference signal (A−B) from the first $\pi$-hybrid 13, and a third $\pi$-hybrid 15*b* for discharging two phase signals j(A−B) and j(B−A) having a $\pi$ phase relation based on the output j(A−B) from the second $\pi/2$-hybrid 14*b*. Similar to the splitter 10 of FIG. 5, the present network is capable of producing four phase signals shifted by a phase of $\pi/2$.

Figure 7:
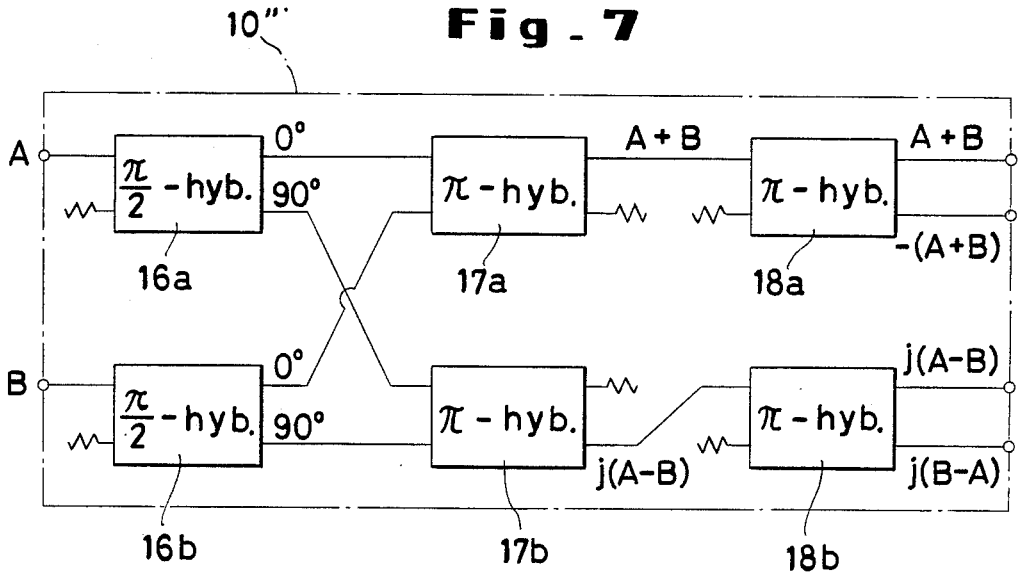

In the phase splitter 10'' of FIG. 7, the input signals A and B are injected respectively into the $\pi/2$-hybrids 16*a* and 16*b* to produce output signals involving phase shifts of 0° and 90°. Of the two output signals, the phase signal of 0° is forwarded to the $\pi$-hybrid 17*a* and the phase signal of 90° to the $\pi$-hybrid 17*b* respectively. From the $\pi$-hybrids 17*a*, 17*b* are respectively derived a sum signal (A+B) and a difference signal j(A−B) which has undergone a phase shift of 90°. These output signals are forwarded respectively to the $\pi$-hybrids 18*a* and 18*b*, there to produce a sum and a difference signal. Consequently, there are obtained four phase signals which are shifted by a phase of $\pi/2$.

The four-phase signals thus derived from the phase splitter are coupled with the output summing lines via the coupling resistors as described above, with the result that output signals of mutual complex conjugates, which correspond to the paired input signals are extracted from the output terminals 5-1, . . . , 5-m, . . . , 5-M. When the resistance values of the coupling resistors 3Rnm, 3Inm are suitably selected, the signal from the input terminal 1-n and that from the input terminal 1-n' can be summed up in phase and the resultant output signal can be extracted from the output terminal 5-m. In the network of the conventional configuration of FIG. 1, phase splitters and coupling resistors are required separately for each of the two symmetrical inputs. In contrast, in the network of the present invention, one system of phase splitters, distribution lines and coupling resistors simultaneously handles two symmetrical input signals and produces corresponding output signals. When the network of this invention is used for an array antenna wherein all the antenna elements are paired off, the number of input circuits is one half of the number of input circuits required in the conventional beam forming network.

Now, the construction of a resistive matrix which permits the number of coupling resistors to be halved by making use of the relationship of mutual complex conjugates existing in the output signals will be described. In the case of a receiving multibeam antenna, this configuration implies shared use of coupling resistors for two symmetrical beams. In a transmitting multibeam antenna, one coupling resistor can be shared for two symmetrical antenna elements.

Figure 8:
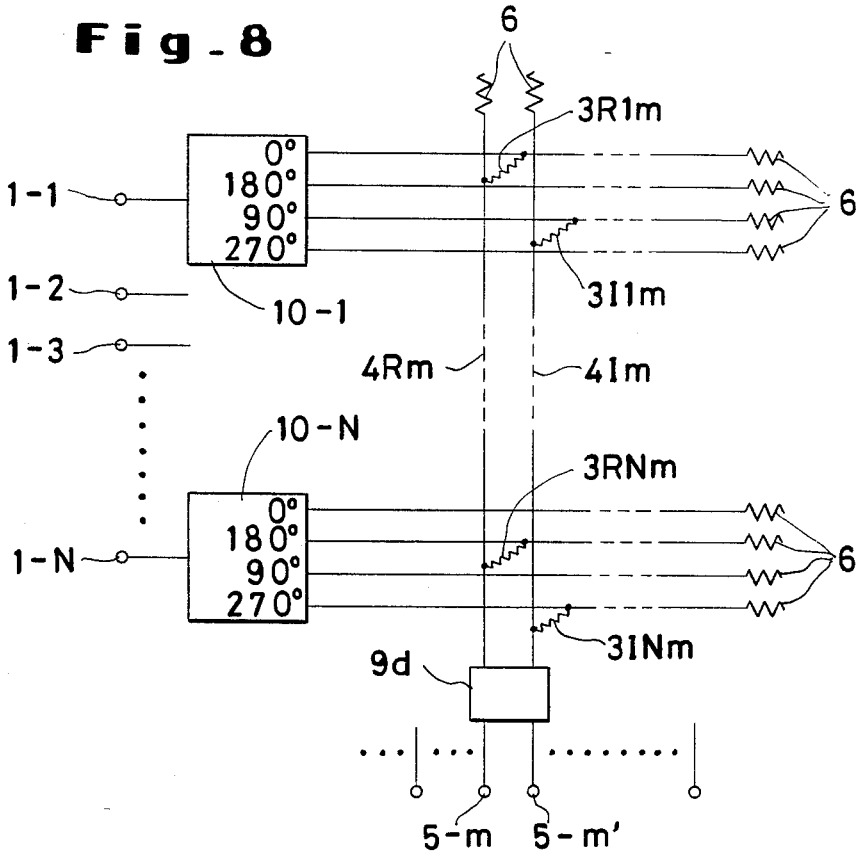
FIG. 8 is a block diagram illustrating the construction of another embodiment of the beam forming network according to the present invention.

FIG. 8 illustrates one embodiment of this configuration in which two output signals are in the relationship of mutual complex conjugates. Although the input side circuits are equal to those of the conventional configuration of FIG. 1, the output summing lines are divided into the lines 4Rm to be coupled only with the real parts (0° or 180°) of the four-phase distribution lines via the coupling resistors 3Rlm, . . . , 3RNm and the lines 4Im to be coupled only with the imaginary parts (90° or 270°) of the four-phase distribution lines via the coupling resistors 3Ilm, . . . , 3INm. These output summing lines are coupled at the coupling resistors with the signals from the antenna elements and subsequently combined in the $\pi$-hybrid 9*d*. Consequently, the sum and the difference of the real part and the imaginary part are extracted from the two output terminals 5-m and 5-m'. Since these signals are in the relationship of mutual complex conjugates, the two output terminals 5-m and 5-m' produce the outputs of the two symmetrical beams. Comparison of this configuration with the conventional configuration of FIG. 1 reveals that the numbers of output summing lines are equal but those of coupling resistors are in the ratio of 1:2.

As described above, this invention provides a beam forming network for a multibeam array antenna involving symmetry in the arrangements of elements and beams and finding widespread actual adoption which, by making use of the aforementioned symmetry, permits the number of coupling points in the matrix to be greatly decreased. Where all the antenna elements and all the beams have symmetry, for example, the number of coupling points in the matrix is reduced to one fourth of the number required for the conventional network. This notable reduction in the number of coupling points permits reduction in size and weight of the beam forming network itself and facilitates the fabrication of the network. Further from the electrical point of view, the reduced number of coupling points assures effective use of resistors less susceptible of the effect of reactance, making it possible to produce a beam forming network enjoying high beam forming characteristics. Further, since this arrangement enables the number of coupling resistors required to be halved, it becomes practicable to give ample coupling for the individual coupling points. As a result, the effect of direct coupling between the distribution and output summing lines can be reduced relatively. This invention, therefore, is highly effective in materializing a beam forming network for the multibeam array antenna using a large number of beams and intended for installation on a satellite. Furthermore, the beam forming network of the present invention enjoys a wide frequency range of approximately three times, and a low power consumption rate of approximately one-third, as large as the conventional network.

Obviously, many modifications and variations of the present invention are possible in light of the above teachings. It is therefore to be understood that within the scope of the appended claims, the present invention may be practiced otherwise than as specifically described.

What is claimed is:

1. A beam forming network, comprising:

a plurality of quadrature phase splitters, each splitter being provided with a pair of input terminals for receiving two input signals, and means for combining and phase-shifting said two input signals so as to output two sets of four phase signals which are shifted by a phase of $\pi/2$ per input signal;

a single set of four distribution lines for receiving said two sets of four phase output signals from each of said quadrature phase splitters;

a plurality of output summing lines provided with output terminals; and a plurality of coupling resistors for connecting said distribution lines to said output summing lines.

2. A beam forming network, comprising:

a plurality of quadrature phase splitters, each splitter being provided with a pair of input terminals for receiving two input signals which are in the relationship of mutual complex conjugates, and means for combining and phase-shifting said two input signals so as to output two sets of four phase signals wherein one of said sets of output signals has a phase relationship of 0°, 180°, 90°, and 270° with respect to one of said input signals, and the other one of said two sets of output signals has a phase relationship of 0°, 180°, 270°, and 90° with respect to the other one of said input signals;

a single set of four distribution lines for receiving said two sets of four phase output signals from each of said quadrature phase splitters;

a plurality of output summing lines provided with output terminals; and a plurality of coupling resistors for connecting said distribution lines to said output summing lines.

3. A beam forming network for a multibeam array antenna involving symmetry in the arrangement of antenna elements or beams, comprising:

a plurality of quadrature phase splitters for receiving two input signals per splitter, and having means for combining and phase-shifting said input signal so as to output four phase signals shifted by a phase of $\pi/2$ per input signal;

a matrix defined by four distribution lines for each phase splitter which are adapted to output said four phase signals from said phase splitter, a plurality of output summing lines, and coupling resistors for connecting one or two distribution lines outputting one or two phase signals, the phase signals outputted through the first distribution line of said four distribution lines from each of said phase splitters representing the real part and each possessing a phase relationship of 0° with respect to the respective input signals of said phase splitter, the phase signals outputted through the second distribution line of said four distribution lines from each of said phase splitters representing the real part and each possessing a phase relationship of 180° with respect to the respective input signals of said phase splitter, the phase signals outputted through the third distribution line of said four distribution lines from each of said phase splitters representing the imaginary part wherein one of said signals possesses a phase relationship of 90° with respect to one of said input signals of said phase splitter while the other one of said output signals possesses a phase relationship of 270° with respect to the other one of said input signals, and the phase signals outputted through the fourth distribution line of said four distribution lines from each of said phase splitters representing the imaginary part wherein one of said output signals possesses a phase relationship of 270° with respect to said one of said input signals of said phase splitter while the other one of said output signals possesses a phase relationship of 90° with respect to said other one of said input signals.

4. A beam forming network according to claim 1, wherein the two input signals received by each of said phase splitters are in the relationship of mutual complex conjugates.

5. A beam forming network according to claim 1, wherein said distribution lines and said summing lines are each provided with a terminal resistor.

6. A beam forming network according to claim 4, wherein said distribution lines and said output summing lines are each provided with a terminal resistor.

7. A beam forming network according to any of claims 1, 4, 5 or 6, wherein the phase signals delivered by the first and second distribution lines of said four distribution lines from each of said phase splitters represent the real part and possess a phase relationship of 0° or 180° relative to the two input signals of said phase splitter, the phase signal delivered by the third distribution line represents the imaginary part and possesses a phase relationship of 90° relative to one of the input signals of the phase splitter and of 270° relative to the other input signal, and the phase signal delivered by the fourth distribution line represents the imaginary part and possesses a phase relationship of 270° relative to said one of the input signals of the phase splitter and of 90° relative to said other input signal.

8. A beam forming network according to claim 7, wherein said four phase splitters are formed of two input terminals for receiving two input signals, a first $\pi$-hybrid for outputting a sum signal and a difference signal of the two input signals from said two input terminals, a second $\pi$-hybrid for outputting two phase signals havine a $\pi$-phase shift relationship based on said sum signal from said first $\pi$-hybrid, a $\pi/2$ phase shifter for effecting a $\pi/2$ phase shift on said difference signal from said first $\pi$-hybrid, and a third $\pi$-hybrid for outputting two phase signals having a $\pi$ phase shift relationship based on the output from said $\pi/2$ phase shifter.

9. A beam forming network according to claim 7, wherein said four phase splitters are formed of a first $\pi$-hybrid for outputting a sum signal and a difference signal of two input signals a first $\pi/2$-hybrid for effecting a $\pi/2$ phase shift on said sum signal from said first $\pi$-hybrid, a second $\pi$-hybrid for outputting two phase signals having a $\pi$-phase relationship based on the output from said first $\pi/2$-hybrid, a second $\pi/2$-hybrid for effecting a $\pi/2$ phase shift on the difference signal from said first $\pi$-hybrid, and a third $\pi$-hybrid for outputting two phase signals having a $\pi$-phase relationship based on the output from said second $\pi/2$-hybrid.

10. A beam forming network according to claim 7, wherein said four phase splitters are formed of a first $\pi/2$-hybrid for producing two phase signals by effecting a $\pi/2$ phase shift on one of the two input signals, a second $\pi/2$-hybrid for producing two phase signals by effecting a $\pi/2$ phase shift on the other input signal, a first $\pi$-hybrid for receiving two phase signals of 0° from said first and second $\pi/2$-hybrids and outputting a sum signal of said two phase signals, a second $\pi$-hybrid which receives the sum signal from said first $\pi$-hybrid and is adapted to output two signals with the same amplitude and out of phase relative to each other, a third $\pi$-hybrid for receiving two 90° phase-shifted signals from said first and second $\pi/2$-hybrids and outputting a difference signal of said two phase signals, and a fourth $\pi$-hybrid which receives the difference signal from said third $\pi$-hybrid and is adapted to output two difference signals with the same amplitude and out of phase relative to each other.

11. A beam forming network according to any of claims 1, 4, 5 or 6, wherein each of the output summing lines which form a matrix in conjunction with said distribution lines is connected to two distribution lines for respective phase splitters, which output two signals, one representing the real part and the other representing the imaginary part, via at least one coupling resistor having a resistance value determined by a phase shift to be given to relevant input signals.

12. A beam forming network according to claim 7, wherein each of the output summing lines which form a matrix in conjunction with said distribution lines is connected to two distribution lines for respective phase splitters, which output two signals, one representing the real part and the other representing the imaginary part, via at least one coupling resistor having a resistance value determined by a phase shift to be given to relevant input signals.

13. A beam forming network according to any of claims 1, 4, 5 or 6, wherein one of two output summing lines for each phase splitter is coupled with the distribution line delivering one of the phase signals of the real part and the other output summing line is coupled with another distribution line delivering one of the phase signals of the imaginary part through the medium of at least one coupling resistor having a resistance value determined by a phase shift to be given to relevant input signals, and a $\pi$-hybrid for a pair of output signals in the relationship of mutual complex conjugates, having means for synthesizing two phase signals from said two output summing lines to discharge the paired output signals in the relationship of mutual complex conjugates is provided.

14. A beam forming network according to claim 7, wherein one of two output summing lines for each phase splitter is coupled with the distribution line delivering one of the phase signals of the real part and the other output summing line is coupled with another distribution line delivering one of the phase signals of the imaginary part through the medium of at least one coupling resistor having a resistance value determined by a phase shift to be given to relevant input signals, and a $\pi$-hybrid for a pair of output signals in the relationship of mutual complex conjugates, having means for synthesizing two phase signals from said two output summing lines to discharge the paired output signals in the relationship of mutual complex conjugates is provided.

15. A beam forming network according to any of claims 1, 4, 5 or 6, which is applied to transmitting multibeam antenna.

16. A beam forming network according to claim 7, which is applied to transmitting multibeam antenna.

17. A beam forming network according to any of claims 1, 4, 5 or 6, which is applied to a receiving multibeam antenna.

18. A beam forming network according to claim 7, which is applied to receiving multibeam antenna.

* * * * *